US005658016A

United States Patent [19]

Goeken

[11] Patent Number: 5,658,016

[45] Date of Patent: Aug. 19, 1997

[54] ATTACHMENT FOR IDENTIFICATION CARD PROVIDING MEDICAL INFORMATION

[76] Inventor: John D. Goeken, 1444 Renwick Rd., Plainfield, Ill. 60544

[21] Appl. No.: 579,664

[22] Filed: Dec. 27, 1995

[51] Int. Cl.[6] ..... B42D 15/10

[52] U.S. Cl. ..... 283/107; 283/101; 283/106; 283/109

[58] Field of Search ..... 283/99, 101, 106, 283/107, 109, 110, 900, 904; 462/12, 36

[56] References Cited

U.S. PATENT DOCUMENTS

| | | | |
|---|---|---|---|
| 3,792,542 | 2/1974 | Cohan | 283/109 |
| 3,958,690 | 5/1976 | Gee Sr. | 283/900 X |
| 4,632,428 | 12/1986 | Brown | 283/900 X |
| 4,722,376 | 2/1988 | Rhyner | 150/147 |
| 4,892,335 | 1/1990 | Taft | 283/109 X |
| 5,100,181 | 3/1992 | Nathans et al. | 283/107 X |
| 5,161,827 | 11/1992 | Grosso | 283/109 X |
| 5,171,039 | 12/1992 | Dusek | 283/900 X |
| 5,197,763 | 3/1993 | Whalen | 283/109 X |
| 5,211,424 | 5/1993 | Bliss | 283/904 X |
| 5,215,334 | 6/1993 | Presson et al. | 283/904 X |
| 5,283,093 | 2/1994 | All | 283/109 X |
| 5,405,473 | 4/1995 | Kuhns | 283/107 X |
| 5,445,417 | 8/1995 | Bromer et al. | 283/109 X |
| 5,601,313 | 2/1997 | Konkol et al. | 283/101 X |

FOREIGN PATENT DOCUMENTS

| | | | |
|---|---|---|---|
| 2 649 934 | 1/1991 | France | 283/106 |
| 2 692 842 | 12/1993 | France | 283/101 |
| 36 44 398 | 7/1988 | Germany | 283/106 |
| 2 251 579 | 7/1992 | United Kingdom | 283/106 |

*Primary Examiner*—Daniel W. Howell
*Assistant Examiner*—Julie A. Krolikowski
*Attorney, Agent, or Firm*—Lee, Mann, Smith, McWilliams, Sweeney & Ohlson

[57] ABSTRACT

An attachment for an identification card for providing information, such as medical data. The medical data is entered on one portion, and an attention strip is provided adjacent to that portion. When the attachment is mounted on an identification card, a fold between that portion and the attention strip is located at one edge of the card, with the medical data being freely available and accessible from the back of the identification card, while the attention strip is on the front to alert the user that information is available on the rear of the card.

11 Claims, 2 Drawing Sheets

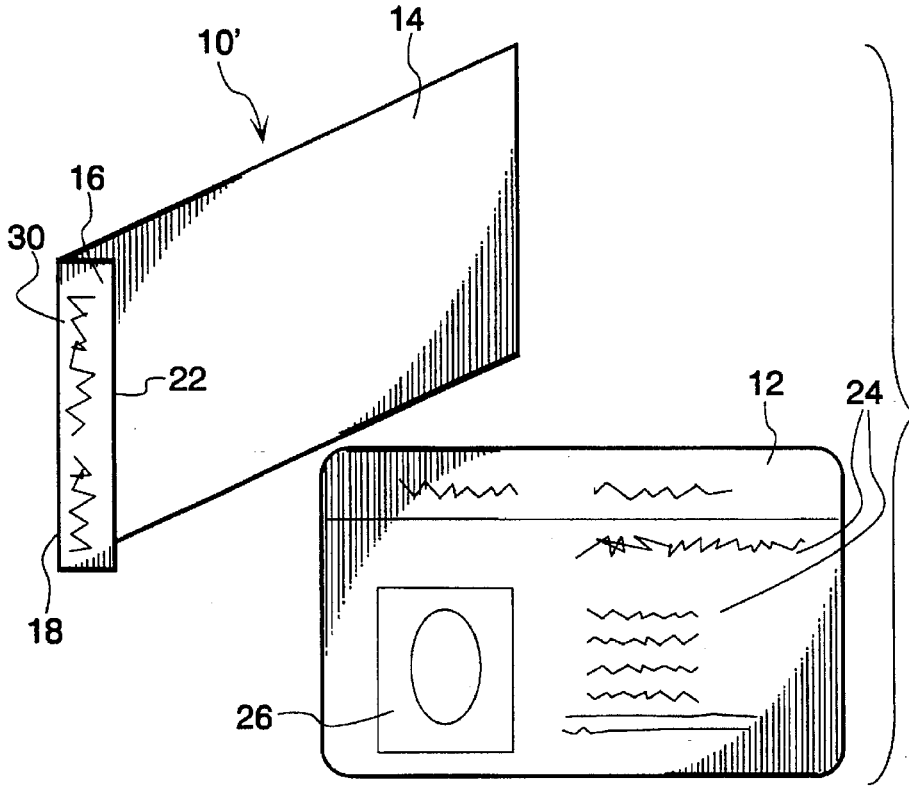
Fig. 3
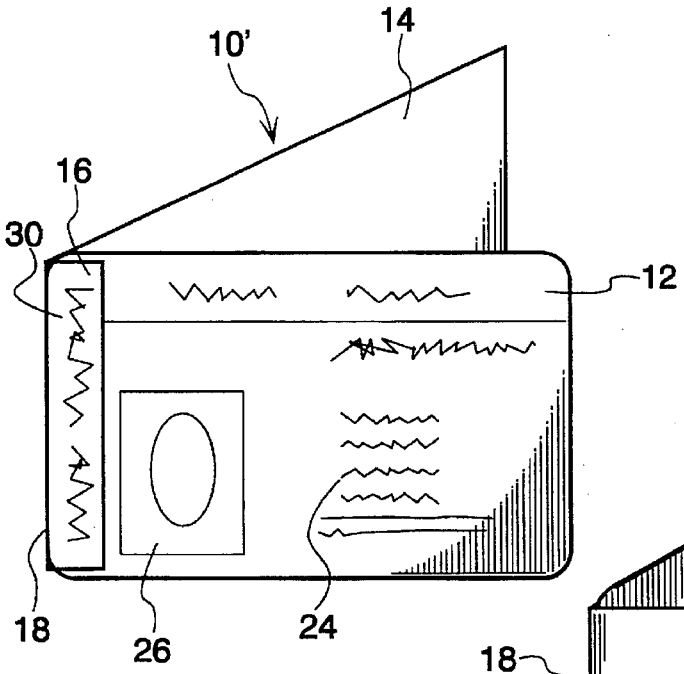
Fig. 4
Fig. 5
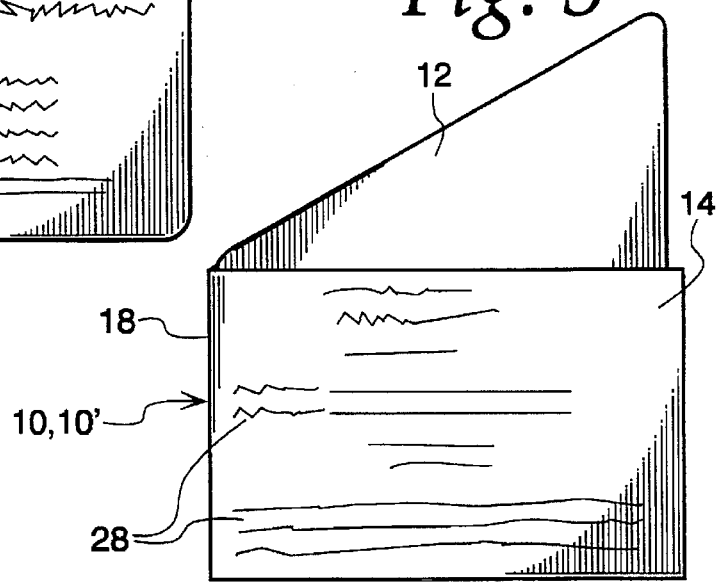

ATTACHMENT FOR IDENTIFICATION CARD PROVIDING MEDICAL INFORMATION

BACKGROUND OF THE INVENTION

This invention relates to providing indicia bearing information as an adjunct to an identification card, and in particular to providing such information which not only contains identification relating to the holder of the card, but also provides a ready means of obtaining the attention of a person looking at the card to advise of the availability of the information.

In a medical emergency, time is of the essence. When a patient is unconscious or otherwise unavailable to assist medical personnel working on that patient, valuable time can be lost if the medical personnel must search for medical data or otherwise seek vital information needed for treating the patient. Therefore, medical identification cards are becoming more prevalent, with the potential patient placing the card in a pursue or wallet so that medical personnel can hopefully locate that information should the bearer not be able to readily provide it. U.S. Pat. No. 4,259,391 is directed to this kind of a card.

While it is advantageous to have medical information available to emergency personnel should a patient not be able to communicate, often a separate card is tucked away in a location that would not normally be investigated by emergency personnel, and therefore that information is not known or communicated. Emergency personnel quite regularly will look to the patient's driver's license or other identification card to obtain personal data regarding the patient, and if medical information were available with the driver's license or identification card, that information would therefore be readily available to the emergency personnel.

SUMMARY OF THE INVENTION

The invention relates to an attachment for a generally flat identification card. The attachment includes an elongated indicia bearing portion and an attention strip which extends proximate the indicia bearing portion. A fold is provided, defining a boundary between the attention strip and the indicia bearing portion. Means is provided for securing the attachment to an identification card at the attention strip with the fold at an edge of the identification card such that the attention strip is situated on one side of the identification card and the indicia bearing portion is freely foldable along the fold toward and away from the other side of the identification card.

In accordance with the preferred form of the invention, the attention strip extends from and along one edge of the indicia bearing portion. The means for securing can comprise an adhesive extending beneath the attention strip and to the fold, or the means for securing can comprise a flat, transparent member extending over and from the attention strip with an adhesive extending beneath the transparent member for securing it to the identification card. In accordance with one form of the invention, the transparent member is configured to substantially cover the identification card.

In accordance with one preferred form of the invention, the transparent member is sufficiently large so that the indicia bearing portion is secured to one part of the transparent member and the attention strip is secured to a second part of the transparent member, with the remaining portion of the transparent member then being applied to, and adhering to, the identification card. In any form of the invention, it is preferred that the adhesive be a pressure-sensitive adhesive.

BRIEF DESCRIPTION OF THE DRAWINGS

The invention is described in greater detail in the following description of examples embodying the best mode of the invention, taken in conjunction with the drawing figures, in which:

FIG. 3 illustrates a second form of the invention, with the attachment just prior to being secured to an identification card, FIG. 4 is a view similar to FIG. 3, but with the attachment secured to the identification card, and FIG. 5 is a rear view of the structure shown in either FIG. 2 or FIG. 4, illustrating the foldable nature of the attachment after it has been secured to the identification card.

DESCRIPTION OF EXAMPLES EMBODYING THE BEST MODE OF THE INVENTION

Figure 1:
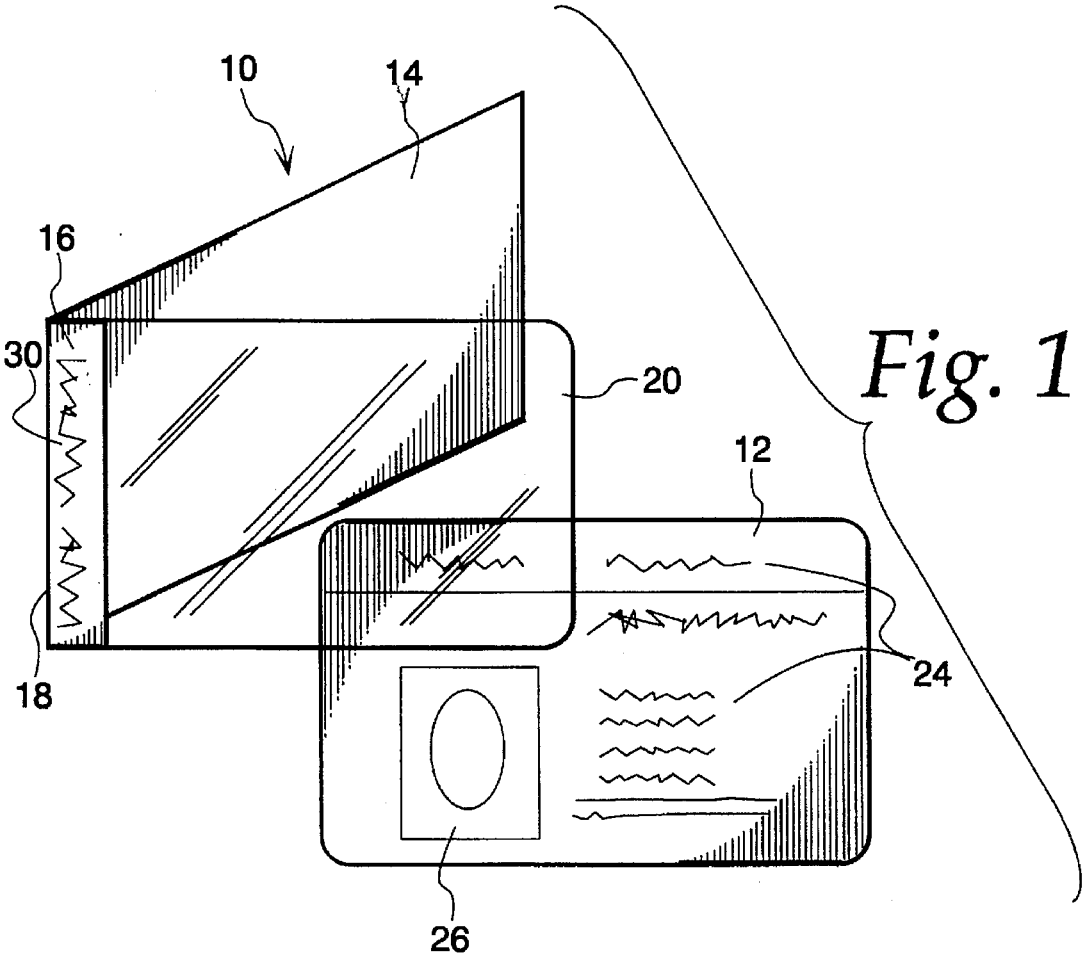
FIG. 1 illustrates an attachment according to the invention, showing the attachment just prior to its being affixed to an identification card.
Figure 2:
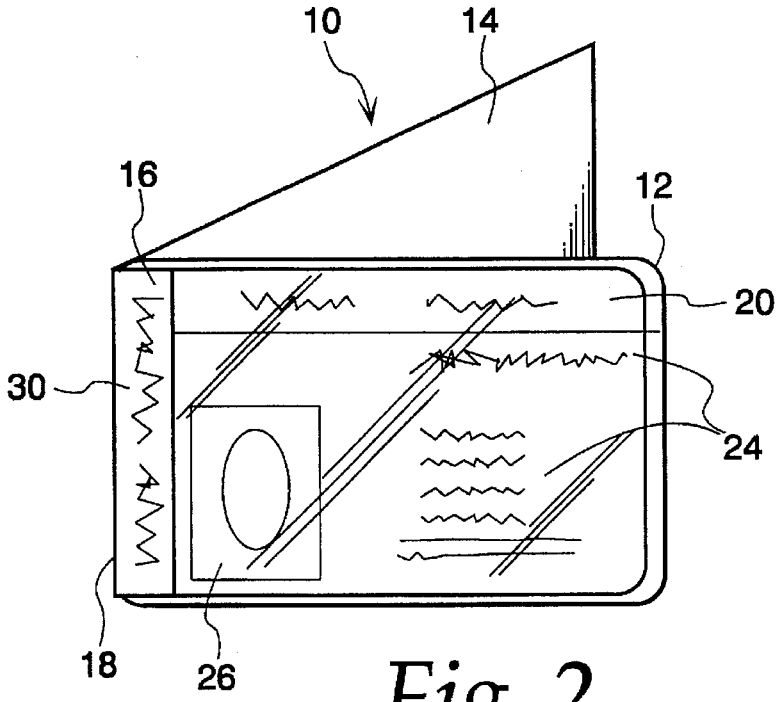
FIG. 2 is similar to FIG. 1, but with the attachment secured to the identification card.

A first form of an attachment according to the invention is illustrated in FIGS. 1 and 2. In this form of the invention, the attachment 10, in FIG. 1, is poised for being secured to an identification card 12, and in FIG. 2 is shown secured to that identification card. The identification card 12 can be a driver's license or any other type of identification means. For the purposes of this application, the term "identification card" will refer to any type of generally flat means of identification typically carded by an individual.

The attachment 10 is composed of an elongated indicia bearing portion 14 and an attention strip 16 which, in this version of the invention, extends from and along one edge of the indicia bearing portion 14. A fold 18 extends between the indicia bearing portion 14 and the attention strip 16, defining a boundary between the two. A flat transparent member 20 extends from the attention strip 16 and is underlain with an adhesive so that when the attachment 10 is applied to the identification card 12 as illustrated in FIG. 2, the fold 18 is at an edge of the identification card 12 and the attention strip 16 is secured to one side of the identification card 12 while the indicia beating portion 14 is freely foldable along the fold 18 toward and away from the opposite side of the identification card 12. As shown, the transparent member 20 is configured to substantially cover the identification card 12 but, since the member 20 is transparent, any data on the identification card 12 is readily visible.

In this form of the invention, it is preferred that the transparent member 20 be the carrier for the indicia portion 14 and the attention strip 16. Thus, it is preferred that the transparent member 20 extend so that the indicia bearing portion 14 is applied to one part of the transparent member 20 and the attention strip 16 is applied to a second part of the transparent member 20, proximate the fold 18. The remaining portion of the transparent member is then applied to the identification card 12 as shown in FIG. 2.

A second form of an attachment 10' according to the invention is illustrated in FIGS. 3 and 4. Elements which are the same as those shown in FIGS. 1 and 2 bear the same reference numerals.

In this form of the invention, a separate transparent member 20 is not employed. Instead, the attention strip 16 is underlain by an adhesive 22, which preferably extends completely beneath the attention strip 16 to the fold 18. The adhesive is preferably pressure-sensitive, and when applied to the identification card 12, allows the indicia bearing portion 14 to be freely foldable toward and away from the identification card 12.

The identification card 12 carries typical information, such as data 24 regarding the bearer, and a photograph 26. When the attachment 10 or 10' is applied to the identification card, the attention strip 16 does not obliterate any information, such as the data 24 or photograph 26, visible on the identification card 12.

At the same type, the indicia bearing portion 14 is freely foldable behind the identification card 12. The indicia portion does not adhere to the rear of the identification card 12, so that any data on the rear of the card 12 remains visible. Medical data or other information 28 can appear on one or both sides of the indicia bearing portion 14 for use by medical personnel.

Were the attachment 10 formed without the attention strip 16, in normal use the indicia bearing portion would be folded against the rear of the identification card 12, and its presence may not readily be visible. With the attention strip 16, however, appropriate indicia 30 can be printed thereon to advise that the indicia bearing portion 14 is, in fact, folded against the rear of the identification card 12. The indicia 30 can be simply the name of the provider of the information on the indicia bearing portion 14, or can be any other type of attention getter, such as a statement "medical information attached", or something similar. Thus, an important part of the invention is the provision of the attention strip 16 which appears on the opposite side of the identification card 12 from the location of the indicia bearing portion 14.

Various modifications can be made to the invention. For example, depending on how the data 24 and/or photograph 26 may be situated on the identification card 12, rather than having the attachment 10 applied to a side edge of the identification card 12, it might be advantageous to have the attachment 10 applied to an edge at the top or bottom of the identification card 12. Also, although the attention strip 16 is illustrated as extending from and along one edge of the indicia beating portion 14, there is no reason why, at least in the embodiment of FIGS. 1 and 2, that, in appropriate circumstances, the attention strip 16 cannot be located elsewhere on the transparent member 20. For example, the attention strip 16 could be located along the top or bottom of the transparent member 20 rather than along an edge by the fold 18, so long as data on the identification card 12 is not obliterated when the attachment 10 is applied to the identification card 12. In addition, although the transparent member 20 is illustrated as adhering to the identification card 12, the member 20 could be a sleeve in which the card 12 is installed, so long as the strip 16 remains on one side of the card 12 when the indicia bearing portion 14 folds against the opposite side.

Various changes can therefore be made to the invention without departing from the spirit thereof or scope of the following claims.

What is claimed is:

1. An attachment for a generally flat identification card, the attachment comprising a. an elongated indicia bearing portion, b. an attention strip extending proximate said indicia bearing portion, said attention strip being smaller in area than said indicia bearing portion, c. a fold defining a boundary between said attention strip and said indicia bearing portion, and d. means for securing said attachment to an identification card at said attention strip with said fold at an edge of the identification card such that said attention strip is situated on and secured to a portion of one side of the identification card and said indicia beating portion is freely foldable along said fold toward and away from the other side of the identification card.

2. An attachment according to claim 1 in which said attention strip extends from and along one edge of said indicia bearing portion.

3. An attachment according to claim 1 in which said means for securing comprises an adhesive extending beneath said attention strip.

4. An attachment according to claim 3 in which said adhesive extends to said fold.

5. An attachment according to claim 1 in which said means for securing comprises a flat transparent member extending over and from said attention strip, and including an adhesive extending beneath said transparent member for securing said transparent member to an identification card.

6. An attachment according to claim 5 in which said transparent member is configured to substantially cover the identification card.

7. An attachment according to claim 1 in which said attention strip extends from and along one edge of said indicia bearing portion.

8. An attachment for a generally flat identification card, the attachment comprising a. an elongated, flat transparent member, b. an indicia bearing portion secured to one part of said transparent member, c. an attention strip secured to a second part of said transparent member, said attention strip being smaller in area than said indicia bearing portion, d. a fold defining a boundary between said one part and said second part, and e. means for securing said attachment to an identification card at said second part with said fold at an edge of the identification card such that said attention strip is located on and secured to a portion of one side of said identification card and said indicia bearing portion is freely foldable along said fold toward and away from the other side of the identification card.

9. An attachment according to claim 8 in which said means for securing comprises an adhesive extending beneath said second part.

10. An attachment according to claim 9 in which said adhesive is a pressure-sensitive adhesive.

11. An attachment according to claim 8 in which said second part is configured to substantially cover the identification card.

* * * * *